United States Patent [19]

Spier

[11] Patent Number: 4,581,792

[45] Date of Patent: Apr. 15, 1986

[54] SEPARABLE FASTENER

[75] Inventor: I. Martin Spier, New York, N.Y.

[73] Assignee: Clements Industries Incorporated, South Hackensack, N.J.

[21] Appl. No.: 467,683

[22] Filed: Feb. 18, 1983

[51] Int. Cl.[4] ..... A44B 11/25

[52] U.S. Cl. ..... 24/575; 24/20 EE

[58] Field of Search ..... 24/575, 577, 578, 20 EE

[56] References Cited

U.S. PATENT DOCUMENTS

| | | | |
|---|---|---|---|
| 2,632,894 | 3/1953 | Louis | 24/575 X |
| 3,263,292 | 8/1966 | Fekete | 24/20 EE |
| 3,545,048 | 12/1970 | Daddona, Jr. et al. | 24/575 |
| 3,869,764 | 3/1975 | Tanaka et al. | 24/577 |
| 3,899,805 | 8/1975 | McMillan | 24/575 |
| 4,123,826 | 11/1978 | Tanaka | 24/577 |

FOREIGN PATENT DOCUMENTS

| | | | |
|---|---|---|---|
| 1101823 | 10/1955 | France | 24/578 |

*Primary Examiner*—Philip C. Kannan

*Attorney, Agent, or Firm*—Blum Kaplan Friedman Silberman & Beran

[57] ABSTRACT

A separable fastener of the press-on/pull-off types comprises similar first and second fastener members, each member including a base having a plurality of tapered projections extending from one face surface and a plurality of tapered receptacles recessed into the face surface. Projections and receptacles are positioned in identical patterns and spacings, each projection and receptacle being totally surrounded and isolated by a portion of the base material. The projections on each fastener member are contoured to engage in the receptacles of the other fastener member with a releasable friction fit.

20 Claims, 12 Drawing Figures

FIG. 8
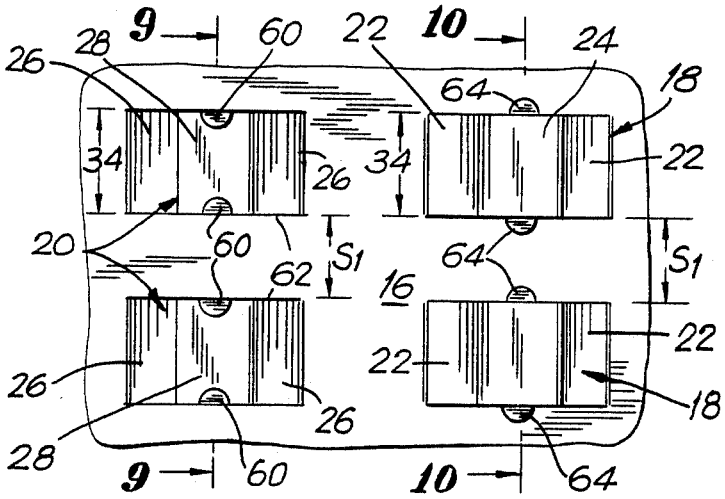
FIG. 9
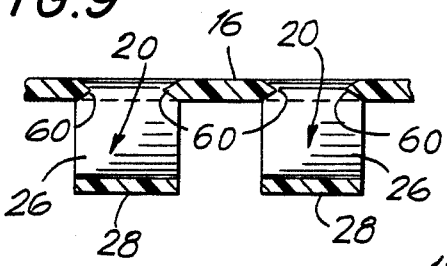
FIG. 10
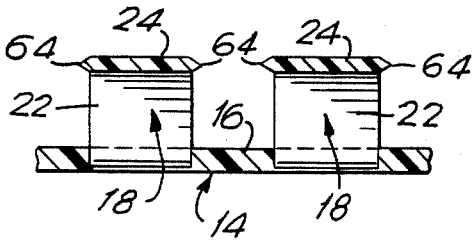
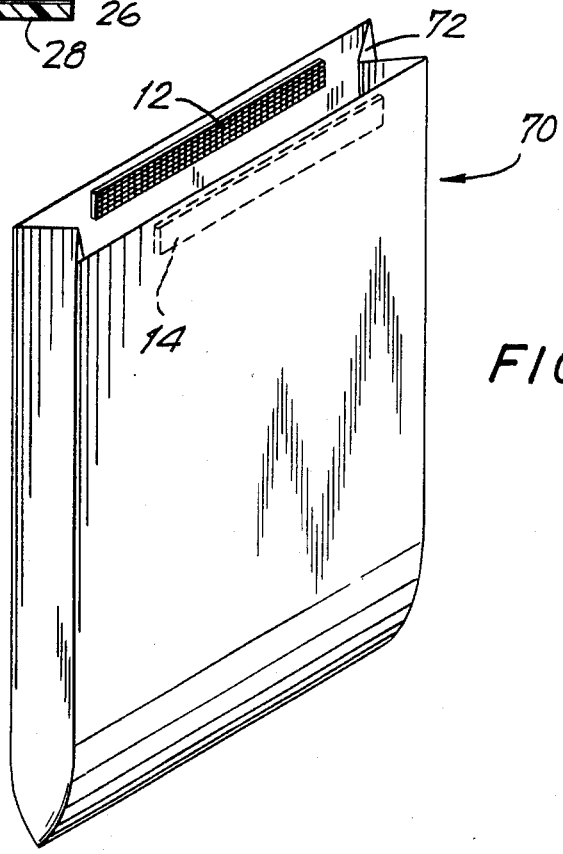
FIG. 12

SEPARABLE FASTENER

BACKGROUND OF THE INVENTION

This invention relates generally to separable fasteners of the type which joins two members simply by pressing the two members together and separates them by pulling apart, and more particularly to separable fasteners having a similar construction for both members. Press-on and pull-off separable fasteners of the prior art generally are of the type where one member has a surface including a large number of closely spaced fastening elements of one type which engage in a face-to-face relationship with another type of closely spaced complementary fastening elements on the other member. On the other hand, zipper-type fasteners comprise two members which are engaged in a side-to-side relationship.

A well known cloth-type press-on/split-off fastener uses a first cloth member having flexible hooks mounted on one face. The other cloth member has a large number of loops mounted on the face. The two members fasten together when pressed face-to-face with the hooks engaging the loops. The two members are separated by pulling the members apart such that the bond between the loops and hooks is broken. The members are reusable; the connection can be made and broken many times. However, a connection made between two portions of the same surface, for example, by looping a tape to form a belt, does not form a good bond when loops mate with loops or hooks engage hooks.

Plastic separable fasteners have been developed wherein a tape includes corrugated resilient strips extending longitudinally along the tape. The corrugations of adjacent strips are staggered, being formed by deformation and piercing of a single flat plastic sheet. Connection of members is made by pressing two identical surfaces face-to-face such that the staggered strips of one tape interleave with the staggered strips of the mating tape. Thus, a tape can be looped around and joined to its ends, for example, to form a strap or belt without the need for two different surface configurations on the mating parts.

However, the alternating strips of corrugated plastic material having a disadvantage, namely, that little material is left between the staggered adjacent strips to bond them together laterally. Therefore, only slight effort is required to cause the tape to tear longitudinally at an intersection between corrugated adjacent strips. Further, when the tape is cut transversely across the corrugations, a frayed edge is left resulting from broken corrugation loops. Additionally, when folded transversely, the tape readily takes a permanent set and reusability is diminished.

What is needed is a separable fastener of the press-on/pull-off type which forms a strong connection, joins to an identically formed member, is tear resistant, reuseable and economical to produce.

SUMMARY OF THE INVENTION

Generally speaking, in accordance with the invention, a separable fastener especially suitable for providing a strong, releasable and reuseable connection is provided. The mating portions of the separable fastener have identical surfaces which are comprised of a dense matrix of surface projections and surface receptacles arranged in non-contiguous transverse rows and longitudinal columns. Each row contains only projections or receptacles. Each column contains an alternating arrangement of projections and receptacles. Between every row and column and therefore between adjacent projections, between adjacent receptacles, and between adjacent projections and receptacles, there is a common planar sheet or base having a generally uniform thickness corresponding to the thickness of the planar stock material from which the separable fastener members are formed.

When joining two members of the separable fastener together, the members are placed face-to-face with the projections of the first member aligned to the receptacles of the second member. When pressed together, the projections of each member enter the receptacles of the other and are frictionally retained therein until separated by pulling apart. The receptacles and projections are identically formed such that opposite faces of the same fastener member appear identical. That is, a hollow projection from one face of the member is a receptacle when viewed from the opposite face of the member. As a result, a single fastener member can be looped back on itself and joined just as effectively as two separate members may be joined.

The flat planar sheet into which receptacles are formed and from which projections extend, surrounds every projection and receptacle and provides transverse strength against tensile forces in the longitudinal columnar direction, and resists longitudinal tearing, and permanent deformation in transverse bending, that is, parallel to the rows. Projections and receptacles taper such that the interconnection, when pressed together, provides a frictional fit between contacting surfaces. Selected taper angles provide optimum tensile and pull-off strength in the connection.

Accordingly, it is an object of this invention to provide improved separable fastener of the press-on/pull-off type having identical surfaces on the mating faces.

Another object of this invention is to provide an improved separable fastener of the press-on/pull-off type which provides a strong connection and is comprised of members which are strong per se and tear resistant.

A further object of this invention is to provide an improved separable fastener of the press-on/pull-off type wherein both faces of the fastening member have identical surfaces and a closed loop can be formed of a single member.

Still another object of this invention is to provide an improved separable fastener of the press-on/pull-off type which is reuseable without detriment to holding capability.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which:

FIG. 8 in a view similar to FIG. 6 of an alternative embodiment of the invention;

FIGS. 9 and 10 are views taken along the lines 9—9 and 10—10 respectively of FIG. 8;

FIG. 12 is a perspective view of a bag including a fastener in accordance with the invention.

DESCRIPTION OF THE PREFERRED EMBODIMENTS

Figure 1:
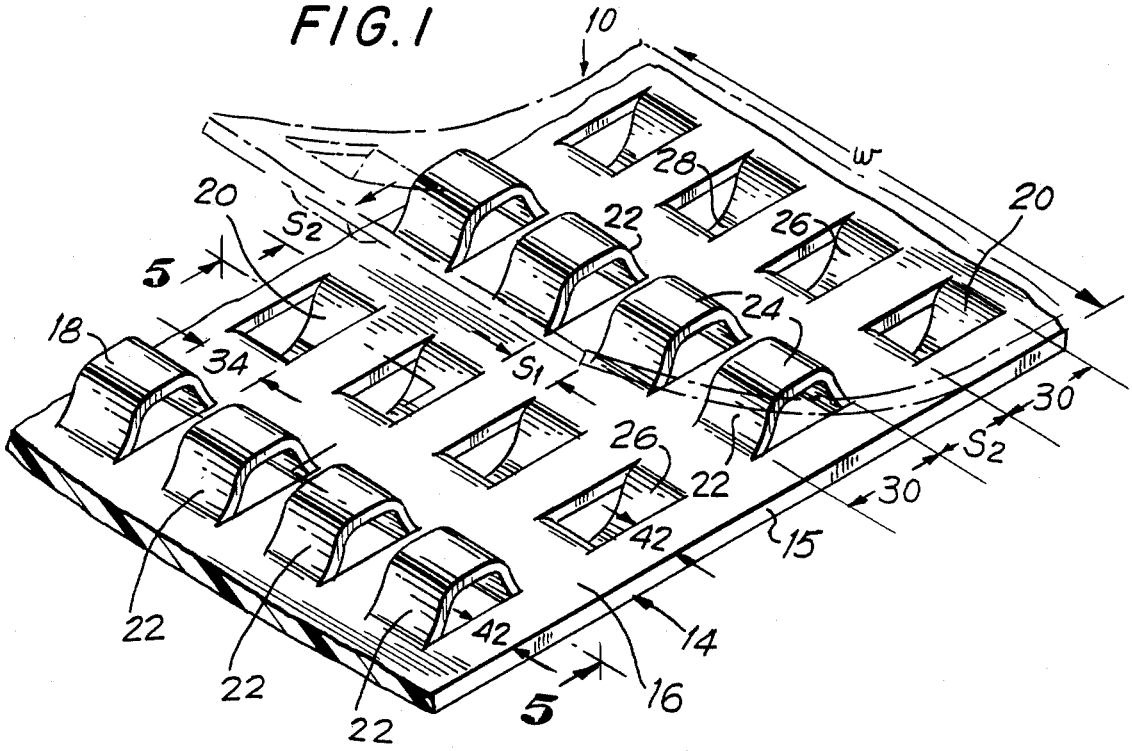
FIG. 1 is a perspective view of a separable fastener in accordance with the invention with indicated members partially joined together and partially pulled apart.

With reference to FIG. 1, a separable fastener 10 in accordance with the invention includes a first member 12, indicated generally, using broken lines, and a second member 14, the members 12, 14, when pressed together, become releasably interconnected, release being achieved by pulling the members 12, 14 apart, as illustrated. Generally speaking, separation is achieved by pulling along one or more edges and peeling the members apart as an adhesive tape is peeled from a surface.

Constructions of the members 12, 14 are substantially similar. Accordingly, the following description will primarily refer to the member 14 with the understanding that the description is applicable to the construction of the member 12 unless otherwise noted.

The member 14 includes a planar sheet 15 or base of finite thickness having a plurality of projections 18 raised above a planar surface 16 and a plurality of receptacles 20 which extend below the planar surface 16. As illustrated in FIG. 1, the projections 18 and receptacles 20 are arranged in a dense grid or matrix pattern of rows and columns formed on the planar surface 16. The member 14 is illustrated as having a finite width w, and for purposes of discussion this width dimension w is considered as extending transversely and represents rows. The length direction of the member 14, transverse to the rows, represents columns. In FIG. 1, the member 14 is shown with indefinite length and could be a portion of, for example, a long continuous strip or tape of flexible plastic material which is stored prior to use in a coil on a roller or is the output of a machine on a production line where the fastener is used, (not shown). On the other hand, both length and width can be defined to form a patch of fastener material which is attached, for example, on the panel and associated flap of a closable container.

Each row is comprised exclusively of projections 18 or receptacles 20. A transverse space S1 exists between every projection 18 in a row and the same space S1 exist between every adjacent receptacle 20 in a row. Longitudinally, a space S2 separates each projection 18 and adjacent receptacle 20.

Figure 2:
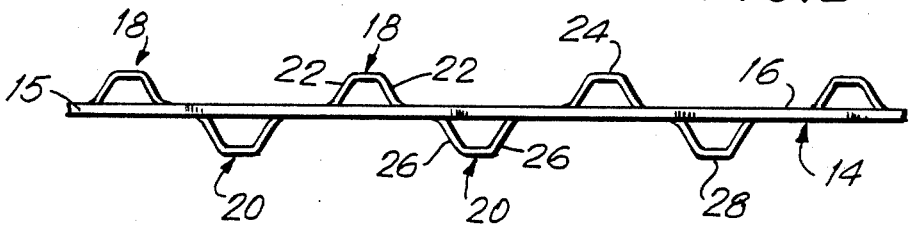
FIG. 2 is a side view to a smaller scale of a member of FIG. 1.
Figure 3:
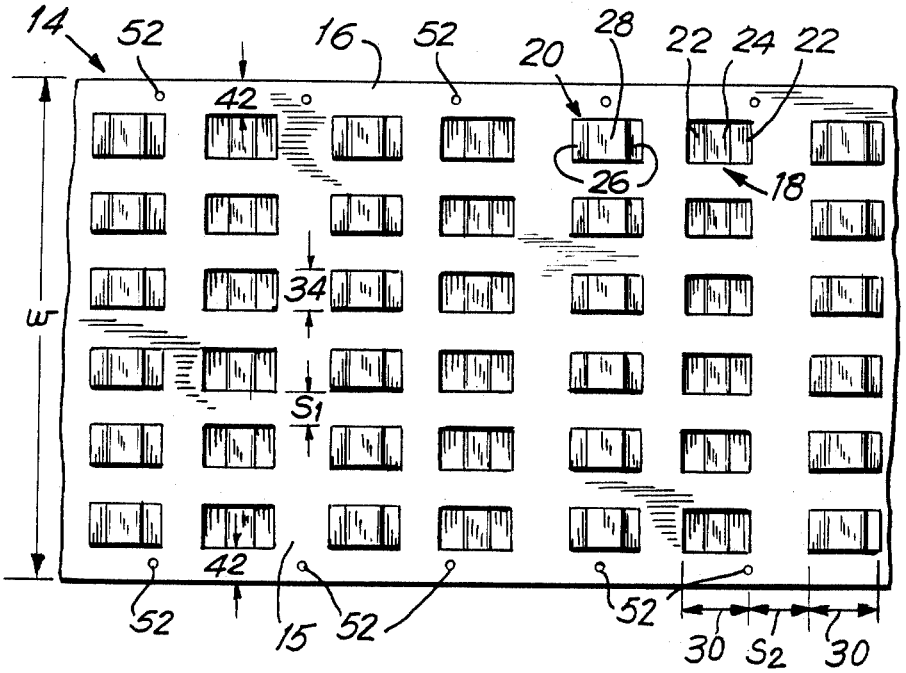
FIG. 3 is a top view of the member of FIG. 2 of a separable fastener in accordance with the invention.
Figure 4:
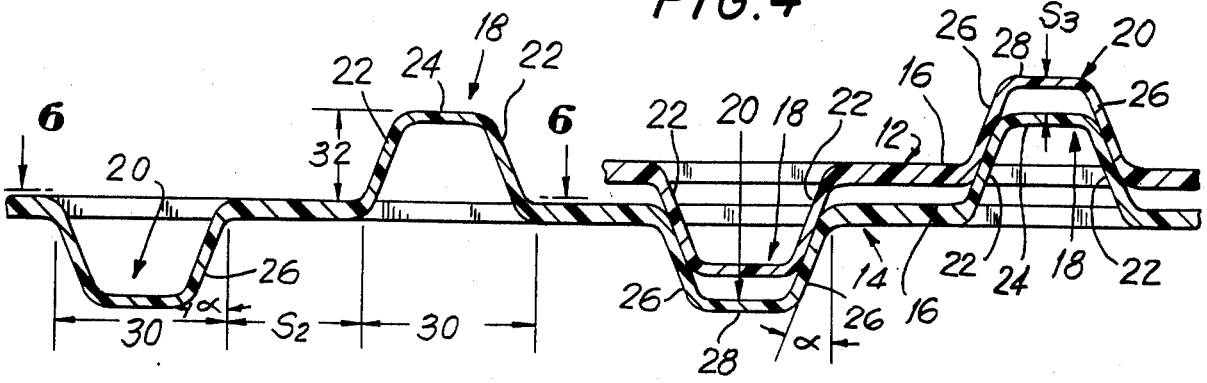
FIG. 4 is a partial sectional side view similar to FIG. 2 to an enlarged scale with joined members.
Figure 5:
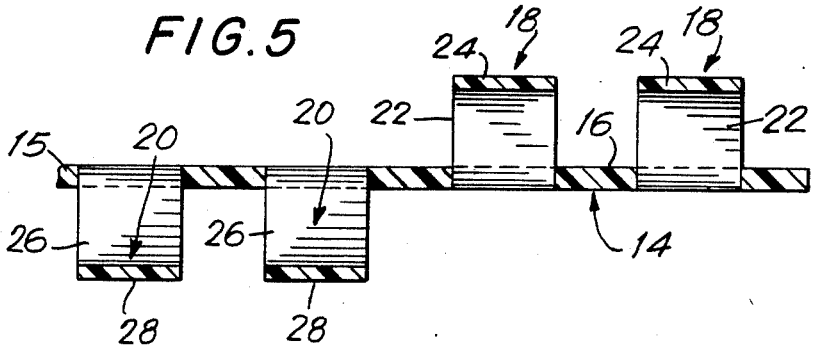
FIG. 5 is a transverse sectional view taken along the line 5—5 of FIG. 1.

The projections 18 are open loops raised above the surface 16, which can be formed, for example, by piercing and locally extruding the planar sheet 15 in a stamping or rolling process. As best seen in FIGS. 2 and 4, the longitudinally facing walls 22 of the projections 18 taper upwardly from the surface 16 to a flat top surface 24. The projections 18 are open loops in that there are no transversely facing side walls.

The receptacles 20 are similarly formed, extending in the opposite direction from the planar surface 16 such that if the member 14 is turned over, the appearance of the backside is identical with that shown in FIG. 1. In particular, what serves as a projection 18 extending from the planar surface 16 serves as a receptacle 20 when viewing the member from the opposite face of the planar sheet 15. For convenience, hereinafter, the terms, projections and receptacles will refer to constructions relative to the faces of the members 12, 14 which are directly opposed, that is, face-to-face, when the members 12, 14 are pressed together to make a connection.

The longitudinally facing walls 26 of the receptacles 20 taper to meet a bottom surface 28, and when the members 12, 14 are pressed together, the projections 18 of the first member 12 nest within receptacles 20 of the second member 14 and the projections 18 of the second member 14 nest within receptacles 20 of the first member 12 until further entry is prevented by friction between the walls 22, 26. Penetration is facilitated by a thinning (FIG. 4) of the walls 22, 26 which occurs during the manufacturing process when the projections and receptacles are formed by piercing and stamping from the planar surface 16. A space S3 exists between the flat top and bottom surfaces 24, 28 when members 12, 14 are joined (FIG. 4). The distance S3 is inversely related to the taper angle $\alpha$ of the projections and receptacles.

Strength of the connection as measured in tension, that is, when pulling parallel to the surface 16 in opposite columnar directions on the connected members 12, 14, is also dependent upon the taper angle $\alpha$. When the length 30 (FIG. 1) of the projections and receptacles is substantially equal to the space S2 between transverse rows, and the projection height 32 is approximately half of the projection length 30, good strength in tension and high resistance to pulling apart is achieved with a taper angle $\alpha$ in the range of 15 to 35 degrees. Satisfactory performance was achieved using polypropylene with a thickness of 0.015 inches in the walls 22, 26, receptacle depth of 0.060 inches and a taper angle $\alpha$ of twenty-two degrees. Longitudinal spacing S2 and length 30 were 0.100 inches. The transverse width 34 of the projections and receptacles, and transverse spacing S1 were 0.062 inches.

The separable fastener 10 in accordance with the invention can be fabricated of many materials suitable to the particular applications. For example, a flexible plastic tape, such as polypropylene, is a construction suitable for making fastening loops and belts wherein a strip of material is looped back upon itself, and the ends are pressed together to form a continuous band. The ends of the loop may include only patches of projections and receptacles which are brought face-to-face for a press on/pull apart connection. Each patch can have many or as few as one projection or receptacle.

Rigid materials, for example, plastic or metal, are also suitable for forming separable fasteners in accordance with the invention. Holding power is the result of the force-fit of the walls, that is, the frictional wedging action when projections 18 are pressed into the receptacles 20. The fasteners can be fabricated by any of stamping, rolling or injection molding techniques as is suited to the selected material and intended use.

Also, the fastener may be an integral portion of the finished product. For example, FIG. 12 illustrates a bag 70 or sack which is sealed along the opening 72 by extending strips of members 12, 14 which are face-to-face on the inside of the bag. The fastening portions may be reinforced by folded layers of material, laminations, or reinforcing inserts, e.g., paper, cardboard, laminate (not shown) without adversely affecting the flexible bag portion.

It should be understood that the members 12, 14 need not extend across the entire bag opening 72, but may be small opposed patches, spaced apart along the opening. Each patch can include as few as one projection 18 or one mating receptacle 20.

To join the members 12 and 14 together (FIG. 1), it is only necessary that the members be aligned with respective longitudinal columns parallel. Then, the members are pressed together and only a slight longitudinal motion may be necessary to register projections 18 with receptacles 20 while applying pressure to compress the two members. In this regard, a more dense matrix, that is, for example with spacing S2 less than receptacle projection length 30, reduces the longitudinal motion required to register the mating members.

To open the fastened joint, it is only necessary to grasp a transverse edge or an end corner of one member and peel it away from the other member. In peeling the members 12, 14 apart, the frictional connection (FIG. 4) between the longitudinally facing walls 22, 26 is broken. Once broken there is no further resistance to separating the members at the projection/receptacle pair.

Figure 6:
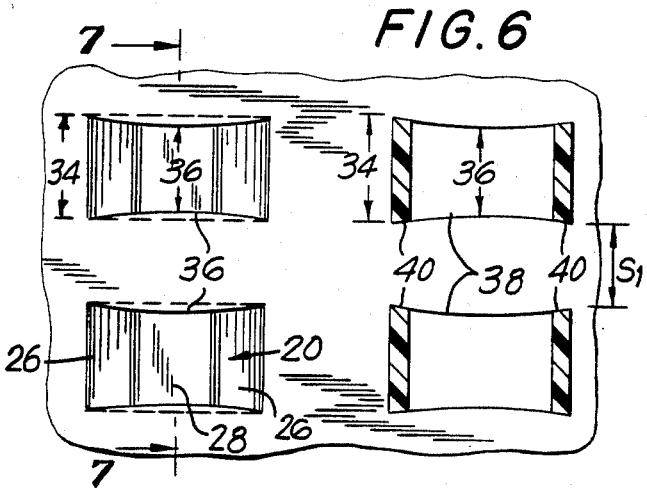
FIG. 6 is a partial top view taken along the line 6—6 of FIG. 4 of an alternative embodiment in accordance with the invention.
Figure 7:
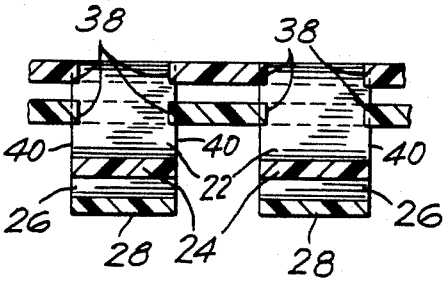
FIG. 7 is a sectional view taken along the line 7—7 of FIG. 6.

In an alternative embodiment, additional holding power and resistance to peeling is provided when the material of the members 12, 14 is of extrudable plastic. In such an embodiment, after the projections 18 and receptacles 20 are formed in the planar sheet 15 in alternating rows, pressure is applied to the sheet material 15 in the spaces S1 between all adjacent receptacles and all adjacent projections, such that the planar surface 16 extrudes slightly (FIG. 6). Thereby, entrance to the receptacle is partially obstructed by extruded material and the receptacle 20 has a minimum opening 36 which is less than the width 34 of the receptacle surfaces 26, 28.

In such an embodiment, when a projection 18 is inserted into a receptacle 20 there is interference between the extruded surfaces 38 and side edges 40 of the walls 22 of the projection 18. When the projection 18 is fully seated in the receptacle 20, there is both frictional contact between the walls 22 of the projection 18 and the walls 26 of the receptacle 20, and also interference between the wall side edges 40 and the extended surfaces 38. Thus, the embodiment of FIG. 6 has a higher holding power than the previously described embodiment of FIGS. 1–5. In particular, the side interference resists member separation even after the frictional bond between the walls 22, 26 is broken.

In another embodiment in accordance with the invention (FIGS. 8, 9, 10) tabs 60 extend inwardly from the material of the base 15 along the longitudinal edges 62 of the receptacle openings. Also, tabs 64 extend laterally from the top surfaces 24 of the projections 18. When the projection 18, frictionally seated in a receptacle 20, is withdrawn in separating the members 12, 14, the tabs 60 interfere with the tabs 64 and side edges of the projection 18 increasing the force required to separate the members 12, 14. The tabs 60, 64 may be extruded from the base 15 and top surface 24 in a process of forming the members, for example by stamping or rolling.

In a further alternative embodiment of the invention the tabs 60 are included at the receptacle opening but the projection tabs 64 are omitted. In another embodiment the tabs 60 are omitted while the tabs 64 are included.

In every embodiment, the flatplanar sheet 15 between receptacles 20 and projections 18, and protective edges 42 (FIGS. 1, 3), when strips or tapes are used as members, provide structural strength which resist tensile forces. The tensile forces must stretch the flat portions before the projections and receptacles are distorted. Thus, a separable fastener in accordance with the invention is superior to the prior art wherein tensile forces act directly on the corrugated surfaces. Further, in order to tear the separable fastener longitudinally, it is necessary to tear the flat planar sheet 15 which provides a greater tear resistance than does a construction where there is no separation between columns or strips of deformations. In folding a member, the ability to fold elastically or in a manner which does not permanently damage the member, is greatly enhanced by the flat portions of the sheet 15. Bending qualities, of course, depend upon the material which is used. Further, when a member is cut to size, for example, when a strip is used as a loop which returns to fasten on itself, an extended length of material from a strip may be cut through the base or sheet 15 between adjacent rows of receptacles and projections. There is no ravelled edge and a tidy appearance and resistance to longitudinal tearing are provided.

Figure 11:
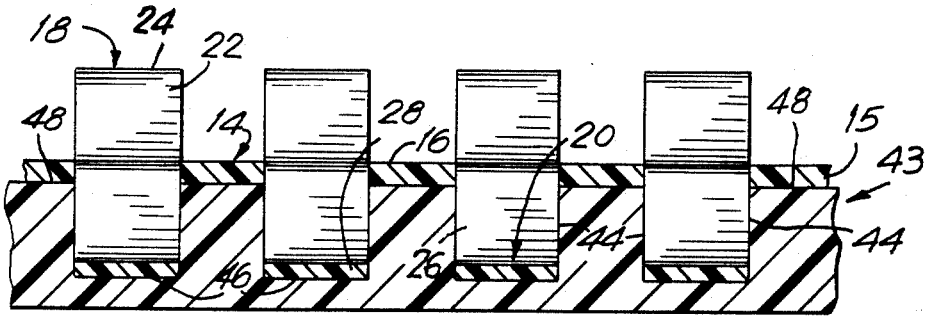
FIG. 11 is an end view of an alternative embodiment of a member of a separable fastener in accordance with the invention.

In an alternative embodiment in accordance with the invention, members are provided with a backing 43 (FIG. 11) which is connected to one face of the separable fastener member 14 so as to form a smooth backing surface for the member. The backing 43 is formed, for example, by extrusion, with a plurality of channels 44 into which the receptacles on the back face of the fastener member 14 are cradled. The bottoms 28 of the receptacles 20 rest upon the bases 46 of the channels 44, and the face surface 48 of the backing 43 rests against the bottom planar surface of the sheet 15. The backing 43 and fastener member 14 are joined together in any suitable fashion, for example, using an adhesive, and thereby a strip is provided which has one smooth surface which can be used, for example, as either the inside or the outside surface of a tie loop or belt.

Sprocket on pin holes 52 in the side strip 42 may be provided for precision transport of the stock material 16 during production of the member 14 by a continuous stamping and piercing method, or for feeding a finished strip.

It should also be understood that where a strip of fastener is produced in a particular length, the projections and receptacles may only be at the ends of the strip. Also, flat portions without projections and receptacles may be provided at any selected intervals along a strip, allowing space for labels, printing, etc.

Whereas, in the figures, projections 18 and receptacles 30 are open on the transverse sides, in alternative embodiments of separable fasteners in accordance with the invention, the projections and receptacles may include transverse side walls. Also, whereas rectangular receptacles 20 and projections 18 are shown in the Figures, in alternative embodiments of separable fasteners in accordance with the invention, the projections and receptacles may have other tapered shapes, for example, cones with continuous tapered walls, ovals, polygons etc.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A separable fastener of the press-on/pull-off types comprising a first fastener member and a second fastener member, each said member including a base having a plurality of projections extending from one face surface thereof and a plurality of receptacles recessed into said one face surface thereof, said projections and said receptacles being positioned on said one surface in identical patterns and spacings, each said projection and each said receptacle being totally surrounded and isolated from adjacent projections and receptacles in said patterns by a portion of said base, the projections on each said fastener member being contoured to engage in the receptacles of the other fastener member with a releasable friction fit, said fastener members being engaged when pressed while said one face surfaces are opposed face-to-face and said patterns are aligned at least in part to oppose projections with receptacles, said receptacles extending from the opposite face surface of said base, said projections being hollow and open at said opposite face surface, said projections extending from said one face surface by a distance equal to the extension of said receptacles from said opposite face surface, said fastener members also becoming engaged when pressed while said one face surface of one member is opposed to said opposite face surface of said second member and with projections and receptacles on said one face surface of said first member are aligned with the receptacles and projections, respectively, on said opposite surface of said second member.

2. A separable fastener as claimed in claim 1, and further comprising a backing strip of finite thickness, one surface of said backing strip having longitudinal channels formed therein, said channels having a depth, width, and spacing from the other to receive therein the extensions of said receptacles from said opposite face surface of said base, said backing strip and said fastener member being joined together with said receptacle extension from said opposite face surface of said base being seated in said grooves, said separable member having only said one face surface with exposed projections and receptacles.

3. A separable fastener as claimed in claim 1, wherein the cross-sectional area and shape at the bases of said projections corresponds to the cross-sectional area and shape at the openings to said receptacles.

4. A separable fastener as claimed in claim 1, wherein said first fastener member includes at least one of a projection and receptacle and said second member includes at least one of a mating projection and receptacle such that a connection may be completed between said first and second fastener members.

5. A separable fastener as claimed in claim 1, wherein said first fastener member includes at least one of a projection and receptacle and said second member includes at least one of a mating projection and receptacle such that a connection may be completed between said first and second fastener members.

6. A separable fastener as claimed in claim 2, wherein said projections and said receptacles have equally tapering walls, said releasable friction fit resulting from the wedging engagement of said tapered walls when said first and second fastener members are pressed together.

7. A separable fastener as claimed in claim 6, wherein said walls have a taper in the range of 15 to 35 degrees.

8. A separable fastener as claimed in claim 6, wherein the width of the entrance opening to at least a portion of said receptacles is constricted, and the corresponding width of said projections exceeds the minimum width of said constricted receptacle opening, an interference being produced between side edges of said projection and said constricted opening to said receptacle at least during pressing together and separating said members.

9. A separable fastener as claimed in claim 6, wherein the width of projection walls is extended at least locally and at least locally exceeds the corresponding width of the receptacle opening, an interference being produced between the extended walls and said opening to said receptacles at least during pressure together and separating said members.

10. A separable fastener as claimed in claim 6, wherein said identical patterns comprise longitudinal columns and transverse rows of said projections and receptacles.

11. A separable fastener as claimed in claim 10, wherein said projections and receptacles are rectangular, longitudinally-facing walls having said taper.

12. A separable fastener as claimed in claim 11, wherein the width of the entrance opening to at least a portion of said receptacles is constricted, said width being measured in the direction of said rows, and the width of said tapered walls in the direction of said rows exceeds the minimum width of said constricted receptacle opening measured in said row direction, an interference being produced between the side edges of said tapered walls and said constricted opening to said receptacle.

13. A separable fastener as claimed in claim 11, wherein said transverse rows include only projections or receptacles and said longitudinal columns include alternating projections and receptacles.

14. A separable fastener as claimed in claim 13, wherein the spacing between projections and receptacles in said columns equals the longitudinal length of said receptacles and projections, and the transverse space between receptacles and projections in said rows is equal to the transverse width of said receptacles and projections.

15. A separable fastener as claimed in claim 13, wherein said fastener members are strips of extended length in the direction of said columns, said bases extending transversely to said columns on both sides of said strip, said base extensions forming a protective edge.

16. A separable fastener as claimed in claim 10, wherein said projections and receptacles are rectangular, longitudinally facing walls having said taper, the transversely facing sides of said projections and receptacles being open.

17. A separable fastener as claimed in claim 16, wherein the width of the entrance opening to at least a portion of said receptacles is restricted, said width being measured in the direction of said rows, and the width of said tapered walls in the direction of said rows exceeds the minimum width of said constricted receptacle opening measured in said row direction, an intereference being produced between the side edges of said tapered walls and said constricted opening to said receptacle.

18. A separable fastener as claimed in claim 16, wherein said transverse rows include only projections or receptacles and said longitudinal columns include alternating projections and receptacles.

19. A separable fastener as claimed in claim 18, wherein the spacing between projections and receptacle in said columns equals the longitudinal length of said receptacles and projections, and the transverse space between receptacles and projections in said rows is equal to the transverse width of said receptacles and projections.

20. A separable fastener of the press-on/pull-off types comprising:

a first fastener member and second fastener member, each said member being spaced apart on a common base and having a plurality of projections extending from one face surface thereof and a plurality of receptacles recessed into said one face surface thereof and extending from the opposite face surface thereof, said projections and said receptacles being positioned on said one surface in identical patterns and spacings, said projections being hollow and open at said opposite face surface, said projections extending from said one face surface by a distance equal to the extension of said receptacles from said opposite face surface, each said projection and each said receptacle being totally surrounded and isolated from adjacent projections and receptacles in said patterns by a portion of said base, the projections on each said fastener member being contoured to engage in the receptacles of the other fastener member with a releasable friction fit, said fastener members being engaged when pressed while said one face surfaces of each member are opposed face-to-face and said patterns are aligned at least in part to oppose projections with receptacles, said fastener members also becoming engaged when pressed while said one face surface of one member is opposed to said opposite face surface of said second member, with projections and receptacles on said one face surface of said first member being aligned with the receptacles and projections, respectively, on said opposite surface of said second member, whereby said base is subject to being formed into a closed loop by engaging said first and second fastener members.

* * * * *